US006769497B2

(12) United States Patent
Dubinsky et al.

(10) Patent No.: US 6,769,497 B2
(45) Date of Patent: Aug. 3, 2004

(54) USE OF AXIAL ACCELEROMETER FOR ESTIMATION OF INSTANTANEOUS ROP DOWNHOLE FOR LWD AND WIRELINE APPLICATIONS

(75) Inventors: Vladimir Dubinsky, Houston, TX (US); Pushkar N. Jogi, Houston, TX (US); James V. Leggett, III, Houston, TX (US); Douglas J. Patterson, Houston, TX (US); Alexei Bolshakov, Houston, TX (US); Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/167,332

(22) Filed: Jun. 11, 2002

(65) Prior Publication Data

US 2002/0195276 A1 Dec. 26, 2002

Related U.S. Application Data

(60) Provisional application No. 60/298,299, filed on Jun. 14, 2001.

(51) Int. Cl.[7] ..... E21B 44/02

(52) U.S. Cl. ..... 175/27; 175/45

(58) Field of Search ..... 175/27, 40, 45; 33/302, 304; 73/152.03, 152.44; 324/356, 359

(56) References Cited

U.S. PATENT DOCUMENTS

| | | | | |
|---|---|---|---|---|
| 2,688,871 A | | 9/1954 | Lubinski | 73/151.5 |
| 3,365,447 A | | 1/1968 | O'Mant et al. | 260/240 |
| 3,777,560 A | | 12/1973 | Guignard | 73/151.5 |
| 4,545,242 A | | 10/1985 | Chan | 73/152 |
| 4,783,742 A | * | 11/1988 | Peters | 33/304 |
| 4,797,822 A | | 1/1989 | Peters | 364/422 |
| 4,843,875 A | | 7/1989 | Kerbart | 73/151.5 |
| 5,321,982 A | * | 6/1994 | Fay et al. | 73/152.44 |
| 5,522,260 A | | 6/1996 | Chappellat et al. | 73/151 |
| 5,551,286 A | | 9/1996 | Booer | 73/152.45 |
| 5,585,726 A | | 12/1996 | Chau | 324/326 |
| 5,720,355 A | | 2/1998 | Lamine et al. | 175/27 |
| 5,806,195 A | * | 9/1998 | Uttecht et al. | 33/304 |
| 6,088,294 A | | 7/2000 | Leggett, III et al. | 367/25 |
| 6,480,119 B1 | * | 11/2002 | McElhinney | 175/40 |
| 6,484,819 B1 | * | 11/2002 | Harrison | 175/45 |
| 2003/0183423 A1 | * | 10/2003 | Brazil et al. | 175/61 |

FOREIGN PATENT DOCUMENTS

| | | |
|---|---|---|
| EP | 0361996 B1 | 9/1992 |
| FR | 2.165.851/72.32475 | 8/1973 |
| GB | 252818 A | 2/2001 |
| WO | WO01/11180 A1 | 2/2001 |

* cited by examiner

*Primary Examiner*—David Bagnell
*Assistant Examiner*—Matthew J Smith
(74) *Attorney, Agent, or Firm*—Madan, Mossman & Sriram, P.C.

(57) ABSTRACT

Determination of the rate of penetration (ROP) of drilling has usually been based upon surface measurements and may not be an accurate representation of the actual ROP. This can cause problems in Logging While Drilling (LWD). Because of the lack of a high-speed surface-to-downhole communication while drilling, a conventional method of measuring ROP at the surface does not provide a solution to this problem. However, the instantaneous ROP can be derived downhole with a certain degree of accuracy by utilizing an accelerometer placed in (or near) the tool to measure acceleration in the axial direction. When three-component accelerometers are used, the method may be used to determine the true vertical depth of the borehole.

17 Claims, 5 Drawing Sheets

USE OF AXIAL ACCELEROMETER FOR ESTIMATION OF INSTANTANEOUS ROP DOWNHOLE FOR LWD AND WIRELINE APPLICATIONS

CROSS REFERENCES TO RELATED APPLICATIONS

This application claims priority from U.S. Provisional Patent Application Ser. No. 60/298,299 filed on Jun. 14, 2001.

BACKGROUND OF THE INVENTION

1. Field of the Invention

This invention is related to methods for determining the rate of penetration of a drillbit and using the determined rate of penetration for controlling the operation of downhole logging tools. The method of the invention is applicable for use with both measurement-while-drilling (MWD) tools and wireline tools.

2. Description of the Related Art

In the rotary drilling of wells such as hydrocarbon wells, a drill bit located at the end of a drill string is rotated so as to cause the bit to drill into the formation. The rate of penetration (ROP) depends upon the weight on bit (WOB), the rotary speed of the drill and the formation and also the condition of the drill bit. The earliest prior art methods for measuring ROP were based on monitoring the rate at which the drill string is lowered into the well at the surface. However because the drill string, which is formed of steel pipes, is relatively long, the elasticity or compliance of the string can result in the actual ROP being different from the rate at which the string is lowered into the hole.

U.S. Pat. No. 2,688,871 to Lubinski and U.S. Pat. No. 3,777,560 to Guignard teach methods to correct for this difference by modeling the drill string is as an elastic spring with the elasticity of the string being calculated theoretically from the length of the drill string and the Young's modulus of the pipe used to form the string. This information is then used to calculate ROP from the load applied at the hook suspending the drill string and the rate at which the string is lowered into the well. These methods do not account for the friction encountered by the drill string as a result of contact with the wall of the well. Patent FR 2 038 700 to Gosselin teaches a method of correcting for this effect by making an in situ measurement of the modulus of elasticity. This is achieved by determining the variations in tension to which the drill string is subjected as the bit goes down the well until it touches the bottom. Since it is difficult to determine exactly when the bit touches the bottom from surface measurements, strain gauges are provided near the bit and a telemetry system is required to relay the information to the surface. In MWD applications, the data rate of the telemetry system is necessarily limited. Additionally, this method still does not provide measurements when drilling is taking place.

There have been a number of teachings of the use of Kalman filtering for determining the rate of penetration of a drillbit. For example, Sengbush (FR 2 165 851 and AU 44,424/72), uses a mathematical model applicable for roller cone bits for describing the drill bit cutting rate. The model requires a knowledge of the drill depth, the drill rotational speed, and the weight on bit. Chan in U.S. Pat. No. 5,551,286 discusses a related problem of a wireline logging tool on an elastic cable.

In U.S. Pat. No. 4,843,875 to Kerbart, during an initial period, the well is drilled keeping, on average, the value of weight F of the drill string measured at the surface relatively constant, and the instantaneous values of the drill string rate of penetration $V_S$ and the weight F are measured at the surface at different successive moments. The value of the drill string average rate of penetration $V_{SM}$ at the surface is determined from the values of $V_S$ measured and the successive values of dF/dt of the first derivative with respect to time. The coefficient of apparent rigidity of the drill string during the initial period is then determined from the values of $V_{SM}$, $V_S$ and dF/dt. Finally, the rate $V_F$ is calculated. In U.S. Pat. No. 5,551,286 to Booer, a state space formulation of the model in the Kerbart patent is used with a Kalman filter to determine the downhole ROP. The quantity observed in Booer is the surface displacement. Those versed in the art would recognize that a fundamental problem in Kalman filtering is the identification of the state transition matrix that governs the evolution of the state space model. Kalman filtering is also computationally intensive.

U.S. Pat. No. 5,585,726 to Chau teaches the use of a three-component accelerometer near a drillbit used for boring a near horizontal borehole. Integration of the accelerometer outputs is performed to determine the position of the drillbit. This integration is susceptible to integration errors. In Chau, at specified times, a dipole antenna is used in conjunction with a surface EM transmitter to get an absolute position of the drillbit and to correct for the integration errors. This is possible in near horizontal borcholes but is impractical for deep wells drilled in hydrocarbon exploration.

Determination of the ROP is of particular importance in measurement of compressional and shear velocities of formations in measurement-while-drilling (MWD) tools. In wireline logging, a plurality of acoustic transmitters is used in conjunction with arrays of acoustic receivers for determining these velocities, the transmitters being excited at regular intervals related to the logging speed to give redundant measurements of these velocities. In MWD applications using devices such as that described in U.S. Pat. No. 6,088,294 to Leggett et al, the contents of which are incorporated herein by reference, excitation at regular time intervals is not necessarily desirable if the ROP is time varying. The method of the present invention makes it possible to determine the ROP with relatively simple computations and thus control the operation of the acoustic logging tool.

Generally, depth determination is less a problem in wireline tools. One of the earliest teachings is that of Bowers et al (U.S. Pat. No. 3,365,447) In Bowers, the tension between the tool and its supporting cable is measured, as is the movement of the cable at the surface of the earth. The tension and cable movement are then combined in a computer along with a plurality of constants representative of various characteristics of the cable and its surround medium to produce an output signal representative of the movement of the tool and relating to the changes in tension Examples of the use of accelerometers for wireline use are given in Chan (U.S. Pat. No. 4,545,242) teaches a high resolution method and apparatus for measuring the depth of a tool suspended from a cable. The tool includes accelerometers for measuring its acceleration and this measurement is combined with a cable depth measurement with which the amount of cable in the borehole is determined. A Kalman filter is employed to continually provide estimates of the velocity and depth of the tool from the accelerometer and cable depth measurements. A filter modifier alters operation of the filter during discontinuous motions of the tool such as when it is stuck and slips. A tool sticking detector senses when the tool is stuck and for how long to correspondingly modify the filter by forcing it to more strongly rely upon accelerometer measurements when the tool is stuck and gradually return to normal filter operation when the tool resumes movement after having been stuck. However, as noted above, it is particularly when a tool is stuck that integration of accelerometer measurements tend to become unreliable.

There is a need for a method of determination of depth of a tool in a borehole that is not susceptible to the errors discussed above. The present invention satisfies this need.

SUMMARY OF THE INVENTION

The present invention is a method of determining the rate of penetration of a downhole drilling assembly conveyed in a borehole during drilling of the borehole. An accelerometer on the downhole assembly is used to make measurements indicative of axial motion of the drilling assembly. In one embodiment of the invention, these measurements are used to determine the axial velocity of motion. Maxima or minima of the velocity are identified and from these, the rate of penetration is determined assuming that the penetration occurs in discrete steps. Alternatively, maxima or minima of the axial displacement are determined and these are used to obtain a depth curve as a function of time. In an alternate embodiment of the invention, the rate of penetration is determined from the average acceleration of the downhole assembly and its instantaneous frequency. The determined rate of penetration may then be used to control the operation of a logging while drilling tool. Specifically, the activation of a transmitter of the logging tool is controlled to give measurements at desired depths. This is particularly desirable in array logging tools such as are used in borehole-compensated acoustic logging. Operation of other downhole tools may also be controlled based on depth determination.

In an alternate embodiment of the invention, measurements made using accelerometers are also used to get an estimate of the depth of a downhole tool conveyed on a wireline.

DETAILED DESCRIPTION OF THE INVENTION

Figure 1:
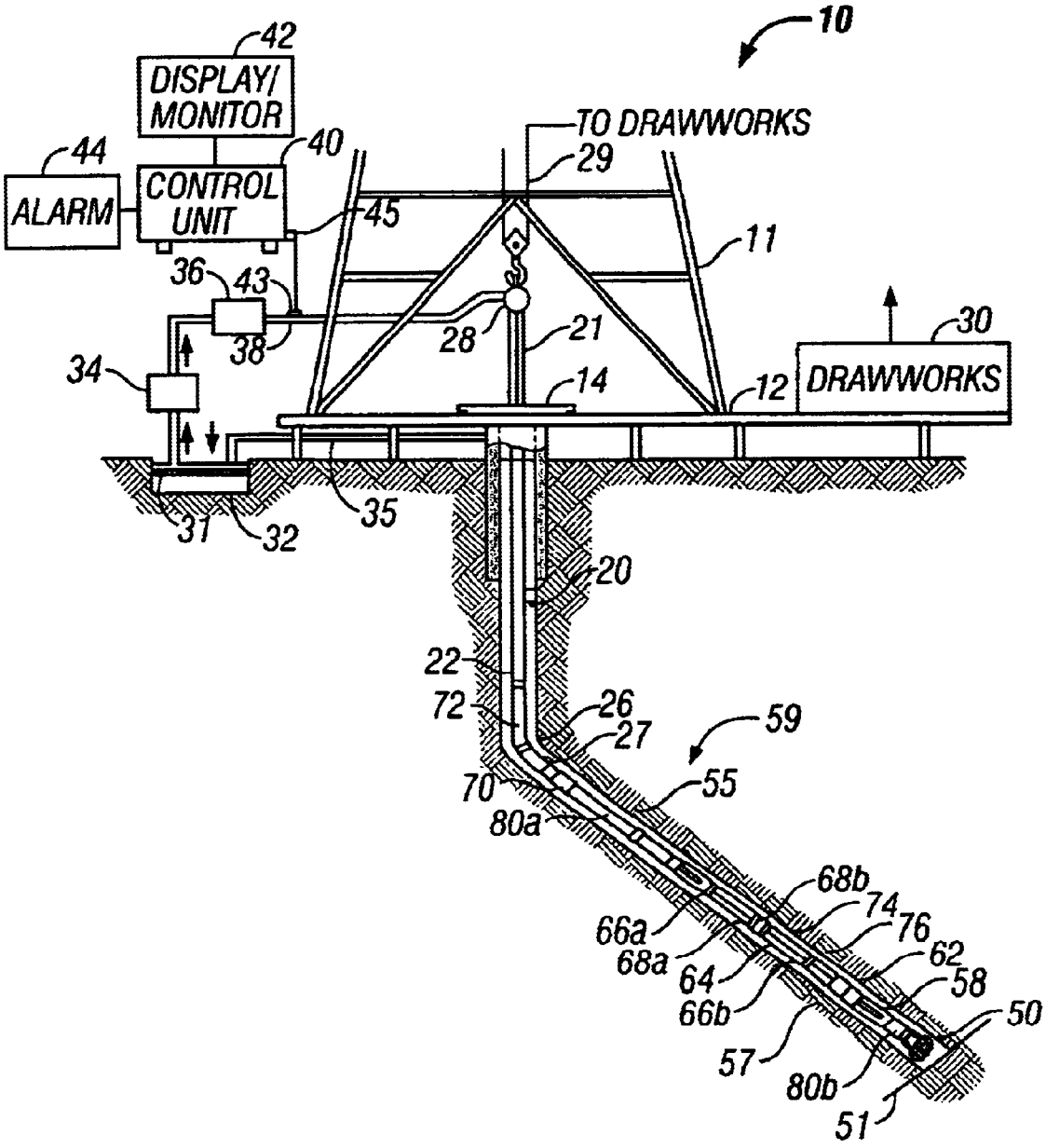
FIG. 1 (Prior Art) shows a schematic diagram of a drilling system having downhole sensor systems and accelerometers.

FIG. 1 shows a schematic diagram of an exemplary drilling system 10 having a downhole assembly containing an acoustic sensor system and surface devices. This is a modification (discussed below) of the device disclosed in U.S. Pat. No. 6,088,294 to Leggett et al. As shown, the system 10 includes a conventional derrick 11 erected on a derrick floor 12 which supports a rotary table 14 that is rotated by a prime mover (not shown) at a desired rotational speed. A drill string 20 that includes a drill pipe section 22 extends downward from the rotary table 14 into a borehole 26. A drill bit 50 attached to the drill string downhole end disintegrates the geological formations when it is rotated. The drill string 20 is coupled to a drawworks 30 via a kelly joint 21, swivel 28 and line 29 through a system of pulleys 27. During drilling operations, the drawworks 30 is operated to control the weight on bit and the rate of penetration of the drill string 20 into the borehole 26. The operation of the drawworks 30 is well known in the art and is thus not described in detail herein.

During drilling operations a suitable drilling fluid (commonly referred to in the art as "mud") 31 from a mud pit 32 is circulated under pressure through the drill string 20 by a mud pump 34. The drilling fluid 31 passes from the mud pump 34 into the drill string 20 via a desurger 36, fluid line 38 and the kelly joint 21. The drilling fluid is discharged at the borehole bottom 51 through an opening in the drill bit 50. The drilling fluid circulates uphole through the annular space 27 between the drill string 20 and the borehole 26 and is discharged into the mud pit 32 via a return line 35. Preferably, a variety of sensors (not shown) are appropriately deployed on the surface according to known methods in the art to provide information about various drilling-related parameters, such as fluid flow rate, weight on bit, hook load, etc.

A surface control unit 40 receives signals from the downhole sensors and devices via a sensor 43 placed in the fluid line 38 and processes such signals according to programmed instructions provided to the surface control unit. The surface control unit displays desired drilling parameters and other information on a display/monitor 42 which information is used by an operator to control the drilling operations. The surface control unit 40 contains a computer, memory for storing data, data recorder and other peripherals. The surface control unit 40 also includes models and processes data according to programmed instructions and responds to user commands entered through a suitable means, such as a keyboard. The control unit 40 is preferably adapted to activate alarms 44 when certain unsafe or undesirable operating conditions occur.

Optionally, a drill motor or mud motor 55 coupled to the drill bit 50 via a drive shaft (not shown) disposed in a bearing assembly 57 rotates the drill bit 50 when the drilling fluid 31 is passed through the mud motor 55 under pressure. The bearing assembly 57 supports the radial and axial forces of the drill bit 50, the downthrust of the drill motor 55 and the reactive upward loading from the applied weight on bit. A stabilizer 58 coupled to the bearing assembly 57 acts as a centralizer for the lowermost portion of the mud motor assembly.

The downhole subassembly 59 (also referred to as the bottomhole assembly or "BHA"), which contains the various sensors and MWD devices to provide information about the formation and downhole drilling parameters and the mud motor, is coupled between the drill bit 50 and the drill pipe 22. The downhole assembly 59 preferably is modular in construction, in that the various devices are interconnected sections so that the individual sections may be replaced when desired.

Still referring to FIG. 1, the BHA also preferably contains sensors and devices in addition to the above-described sensors. Such devices include a device for measuring the formation resistivity near and/or in front of the drillbit 50, a gamma ray device for measuring the formation gamma ray intensity and devices for determining the inclination and azimuth of the drill string 20. The formation resistivity measuring device 64 is preferably coupled above the lower kick-off subassembly 62 that provides signals, from which resistivity of the formation near or in front of the drill bit 50 is determined. A dual propagation resistivity device ("DPR") having one or more pairs of transmitting antennae 66*a* and 66*b* spaced from one or more pairs of receiving antennae 68*a* and 68*b* may be used. Magnetic dipoles are employed which operate in the medium frequency and lower high frequency spectrum. In operation, the transmitted electromagnetic waves are perturbed as they propagate through the formation surrounding the resistivity device 64.

The receiving antennae 68*a* and 68*b* detect the perturbed waves. Formation resistivity is derived from the phase and amplitude of the detected signals. The detected signals are processed by a downhole circuit that is preferably placed in a housing above the mud motor 55 and transmitted to the surface control unit 40 using a suitable telemetry system 72.

The inclinometer 74 and gamma ray device 76 are suitably placed along the resistivity measuring device 64 for respectively determining the inclination of the portion of the drill string near the drill bit 50 and the formation gamma ray intensity. Any suitable inclinometer and gamma ray device, however, may be utilized for the purposes of this invention. In addition, an azimuth device (not shown), such as a magnetometer or a gyroscopic device, may be used to determine the drill string azimuth. Such devices are known in the art and are, thus, not described in detail herein. In the above-described configuration, the mud motor 55 transfers power to the drill bit 50 via one or more hollow shafts that run through the resistivity measuring device 64. The hollow shaft enables the drilling fluid to pass from the mud motor 55 to the drill bit 50. In an alternate embodiment of the drill string 20, the mud motor 55 may be coupled below resistivity measuring device 64 or at any other suitable place.

The drill string 20 contains a modular sensor assembly, a motor assembly and kick-off subs. In a preferred embodiment, the sensor assembly includes a resistivity device, gamma ray device and inclinometer, all of which are in a common housing between the drill bit and the mud motor. Such prior art sensor assemblies would be known to those versed in the art and are not discussed further.

The downhole assembly of the present invention preferably includes a MWD section which contains a nuclear formation porosity measuring device, a nuclear density device and an acoustic sensor system placed above the mud motor 55 for providing information useful for evaluating and testing subsurface formations along borehole 26. The preferred configurations of the acoustic sensor system are described later with reference to FIGS. 2*a*, and 2*b*. The present invention may utilize any of the known formation density devices. Any prior art density device using a gamma ray source may be used. In use, gamma rays emitted from the source enter the formation where they interact with the formation and attenuate. The attenuation of the gamma rays is measured by a suitable detector from which density of the formation is determined.

The porosity measurement device preferably is the device generally disclosed in U.S. Pat. No. 5,144,126, which is assigned to the assignee hereof and which is incorporated herein by reference. This device employs a neutron emission source and a detector for measuring the resulting gamma rays. In use, high energy neutrons are emitted into the surrounding formation. A suitable detector measures the neutron energy delay due to interaction with hydrogen and atoms present in the formation. Other examples of nuclear logging devices are disclosed in U.S. Pat. Nos. 5,126,564 and 5,083,124.

The above-noted devices transmit data to the downhole telemetry system 72, which in turn transmits the received data uphole to the surface control unit 40. The downhole telemetry also receives signals and data from the uphole control unit 40 and transmits such received signals and data to the appropriate downhole devices. The present invention preferably utilizes a mud pulse telemetry technique to communicate data from downhole sensors and devices during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. Other telemetry techniques such as electromagnetic and acoustic techniques or any other suitable technique may be utilized for the purposes of this invention.

A novel feature of the present invention is the use of one or more motion sensors 80*a*, 80*b* to make measurements of the acceleration of components of the downhole assembly. In a preferred embodiment of the invention, the motion sensors are accelerometers. Accelerometer 80*a* is preferably located on the acoustic sensor assembly 70 to provide measurements of the motion of the acoustic sensor assembly. Accelerometer 80*b* is preferably located proximate to the drill bit 50 to provide measurements of the motion of the drillbit that may be different from the motion of the acoustic sensor assembly due to compliance of the intervening portions of the bottom hole assembly. For purposes of determining the rate of penetration, and for controlling the operation of the acoustic sensor assembly (discussed below), it is sufficient that the accelerometers be sensitive to axial motion. However, if additional information about drilling and drillbit conditions is required, accelerometer 80*b* may be a three-component accelerometer.

Figure 2A:
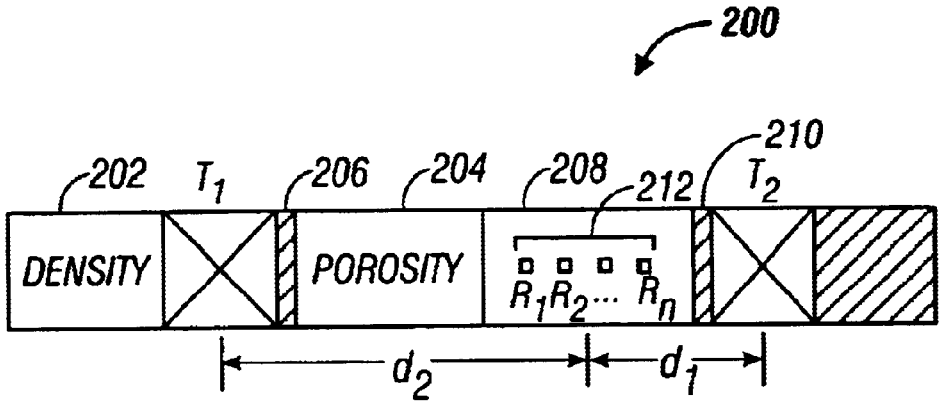
FIG. 2*a* shows an embodiment of an acoustic sensor system for use in conjunction with the system of the present invention.

FIG. 2*a* is a schematic diagram of a portion 200 of the downhole subassembly including an acoustic sensor system of the present invention placed in the MWD section shown in FIG. 1. The subsystem 200 of FIG. 2*a* is preferably placed between the mud motor 55 and the downhole telemetry section 72. The subsystem 200 contains a nuclear density device 202 and a nuclear porosity device 204 of the type described earlier, separated by an acoustic isolator section 206. The density device 202 and the porosity device 204 may be enclosed in a common housing 208 or formed as individual sections or modules. A first acoustic transmitter or a set of transmitters $T_1$ is placed between the density device 202 and the first isolator 206. A second acoustic transmitter or set of transmitters $T_2$ is placed past the porosity device 204 and a second acoustic isolator 210. A plurality of acoustic receivers $R_1$, $R_2$ . . . $R_n$ are placed axially spaced from each other between the transmitters $T_1$ and $T_2$. The distance $d_2$ between the transmitter $T_1$ and the center of the far receiver of the array 212 is preferably less than four and one half (4.5) meters while the distance $d_1$ between transmitter $T_2$ and the near receiver of the array 212 is no less than ten (10) centimeters. Accelerometer 80*a* may be placed at any convenient location (not shown) proximate to the acoustic transmitters and receivers for making measurements of the acceleration of the portion 200 of the downhole assembly. As described below, the accelerometer measurements may be used to determine a parameter of interest of the drilling assembly.

Each of the transmitters and the receivers is coupled to electronic circuitry (not shown) which causes the acoustic transmitters to generate acoustic pulses at predetermined time intervals and the receivers to receive acoustic signals propagated through the formation and also reflected acoustic signals from the borehole formations. In one mode of operation, the acoustic system for determining the formation acoustic velocities is selectively activated when drilling and the acoustic system for determining the bed boundary information is activated when the drilling activity is stopped so as to substantially reduce acoustic noise generated by the drill bit. In an alternative mode of operation, both the velocity and bed boundary measurements may be while the drilling is in progress. Other suitable modes of operation may also be utilized in the system of the present invention.

Figure 3:
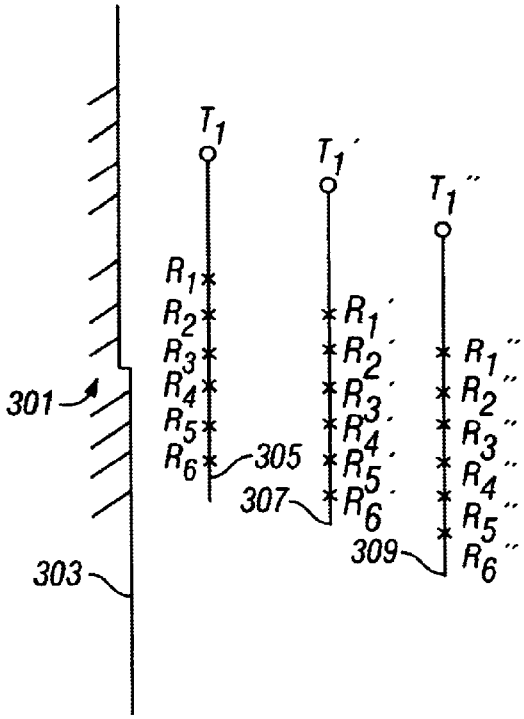
FIG. 3 illustrates the positions of a transmitter and receivers used in obtaining acoustic velocities of formations.

In the present system, an array of two or more receivers is preferred over a smaller number of receivers to obtain more accurate acoustic measurements. It is known that the quality of acoustic measurements may be enhanced by utilizing receiver arrays having a large number of receivers. In operation, the transmitters are preferably energized several times over a known time period and the received signals are stacked to improve resolution. Such data processing techniques are known in the art and are briefly described here. Referring to FIG. 3, by 305 is depicted the location of the transmitter $T_1$ and receivers $R_1$, $R_2$, $R_3$, $R_4$, $R_5$, and $R_6$ at a first time instance. Above the depth indicated by 301 there is a washout in the borehole wall 303 so that the diameter of the borehole is greater above the depth 301 than below. In borehole-compensated logging, formation velocities are determined by measurement of time differences of refracted signals through the formation. It can be seen that the difference of arrival times at receivers $R_3$ and $R_4$ will be affected by the change in borehole diameter at 301 and hence not give an accurate measurement of the formation acoustic velocity. However, any pair of receivers that does not straddle the change in borehole diameter can give a measurement indicative of the formation velocity. Also shown in FIG. 3 are positions 307, 309 of the acoustic assembly when the drilling has proceeded further. By activating the transmitter at depths such as $T'_1$ and $T''_1$ it can be seen that additional redundant measurements may be made: for example, 307 shows that receivers $R'_3$ and $R''_4$ are at the same depths as receivers $R_4$ and $R_5$ at 305. Thus, stacking of the signals is possible to improve the signal to noise ratio. An essential factor in being able to do this is knowing the ROP.

The transmitter $T_1$ is preferably operated at a preselected frequency between 5 to 20 KHz. The downhole computer, placed at a suitable location on the downhole assembly, determines the time of travel of the acoustic signals and thus the velocity of the acoustic signals through the formation by processing signals from the first transmitter $T_1$ and the receivers by using any of the methods known in the art. In the configurations shown in FIGS. 2*a–b*, all of the acoustic sensors are placed above the mud motor 55. Alternatively, some of the receivers may be placed above the mud motor and the others below the mud motor.

It would be apparent to those versed in the art that due to the limited capability of mud pulse telemetry, control of the firing of the transmitters from the surface is not possible even if the downhole ROP could be determined at the surface using any of the methods discussed above. For this reason, the present invention determines the ROP downhole. The discussion that follows is applicable for either position of the accelerometer discussed above.

In a first embodiment of the invention, it is assumed that the actual drilling process involves a series of steps of penetration of the drillbit into the rock while breaking the rock. To estimate the ROP, the accelerometer data a(t) are first integrated using the trapezoidal rule to obtain instantaneous velocities v(t) as $$v(t) = \int_0^t a(\tau)\,d\tau \tag{1}$$

With the assumption that the penetration proceeds in steps, the ROP is then estimated as a sum of all local maxima or minima of these velocities as $$ROP^+ = k^+ \sum_{i=1}^{n-2} v_i\{v_i > v_{i-1},\ v_i > v_{i+1}\} \tag{2}$$

or from $$ROP^- = k^- \sum_{i=1}^{n-2} v_i\{v_i < v_{i-1},\ v < v_{i+1}\} \tag{3}$$

where $v_i = v(it_s)$ with $t_s$ as a sampling interval, n is the total number of samples, and $k^{31}$ and $k^+$are constants. The actual selection depends upon the sign convention used for the accelerometer output. ROP is usually defined with increasing depth downwards. Hence if the accelerometer output is positive upwards, then eq. (3) is chosen whereas if the accelerometer output is positive downwards, then eq. (2) is used. Integration of eq. (2) or eq. (3) gives the relative change in depth of the downhole assembly.

Figure 4:
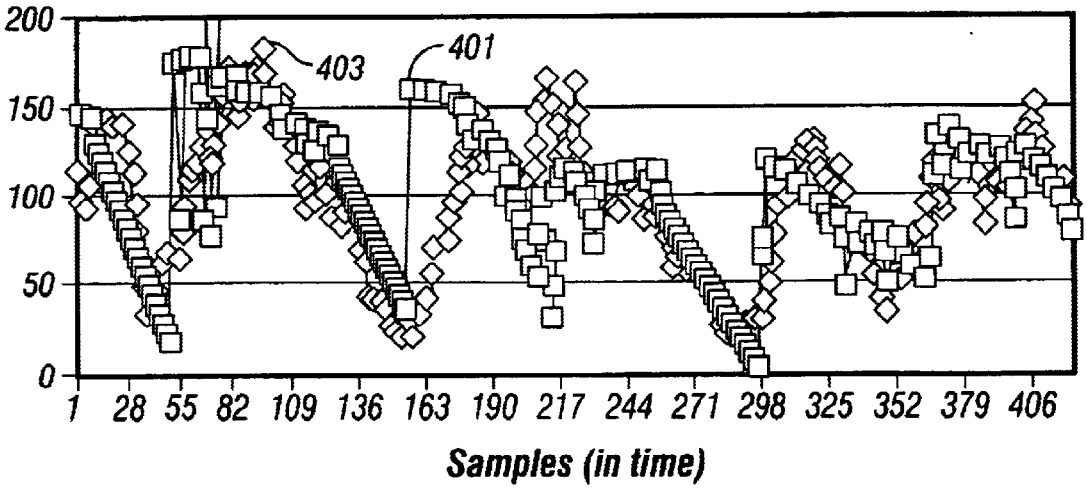
FIG. 4 shows a comparison of ROP determined by the method of the present invention with ROP measurements made at the surface.

Referring now to FIG. 4, a comparison between the results obtained by downhole measurements 401 and surface measurements 403 is shown. The horizontal axis is time. In typical operations, the samples are taken at intervals that are 30–60 seconds apart. while the vertical axis is the ROP. In the example shown, the scale is in ft/hr. The overall agreement is good but the downhole measurements show discontinuities that are not present in the surface measurements. This is to be expected as the surface measurements would be smoothed out by the compliance of the intervening drillstring.

A second embodiment of the invention also performs an integration of the accelerometer data. As in eq. (1), an integration of the accelerometer measurements performed to give the velocity:

$$\int_0^t a(\tau)\,d\tau = v(t) - v(0) \tag{4}$$

Note that in eq. (4), the initial velocity of the drillstring is explicitly included.

Figures 5A, 5B, 5C:
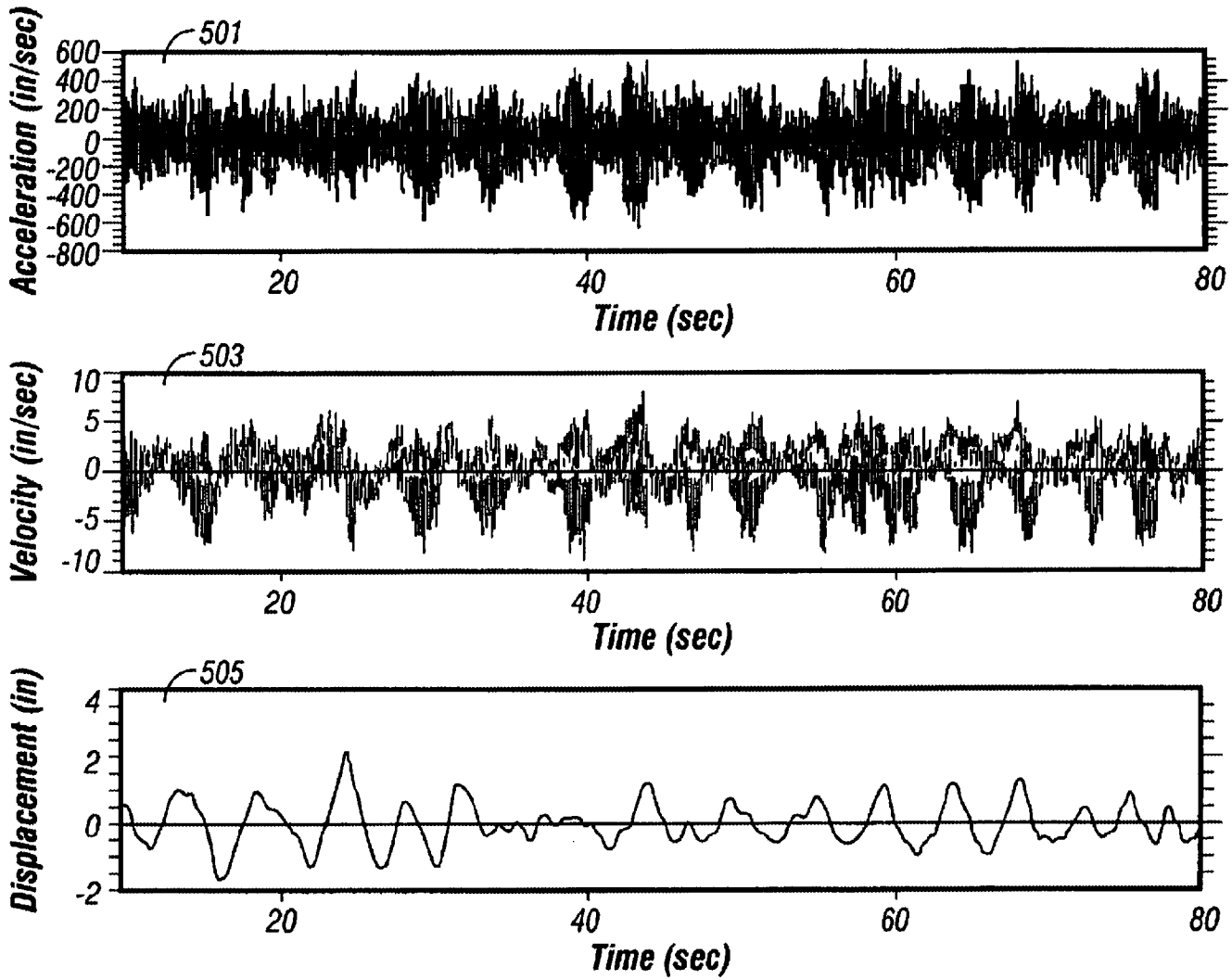
FIGS. 5*a*, 5*b* and 5*c* show an example of accelerometer signals, determined velocities and determined displacement in a downhole assembly.

Integration of eq. (4) gives $$\int_0^t [v(t) - v(0)]\,dt = d(t) - d(0) - tv(0) \tag{5}$$

where d(t) is the displacement. On integrating a(t) and removing the average value v(0), the dynamic part of velocity v(t) is obtained. Similarly the dynamic part of displacement can be obtained by removing its average value of displacement as well as subtracting the slope, t*v(0). The integration is performed by the trapezoidal method. 501 in FIG. 5*a* shows the plot of bit acceleration. Positive acceleration is defined to be increasing velocity upwards. 503 and 505 in FIGS. 5*b* and 5*c* show the dynamic velocity and dynamic displacement using the above method. Again, positive velocity and positive dynamic displacement are upwards. 80 seconds of data are shown.

Figure 6A:
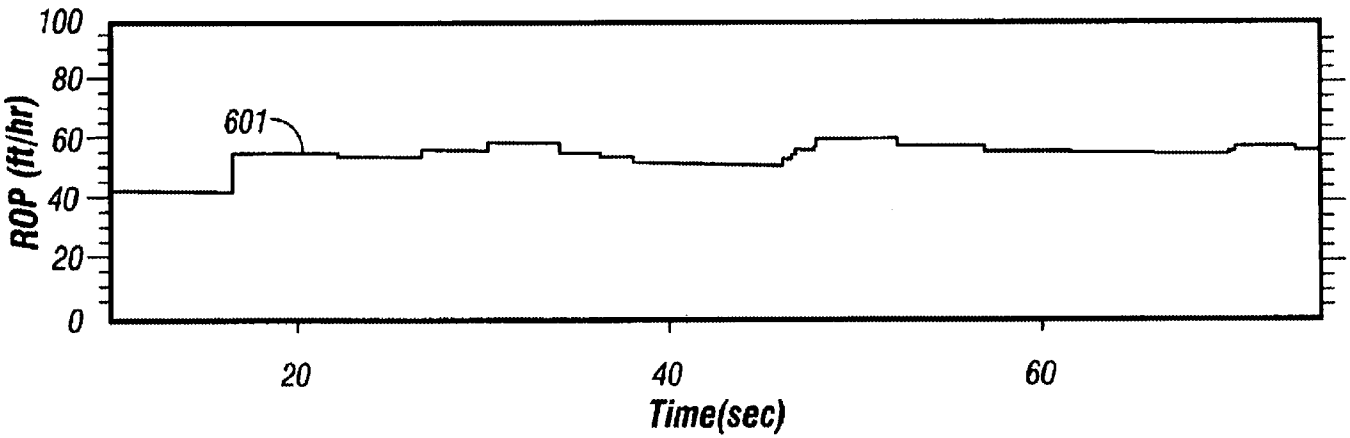
FIGS. 6*a* and 6*b* show an example of the determined ROP and drilling depth for the data in FIG. 5*a*.
Figure 6B:
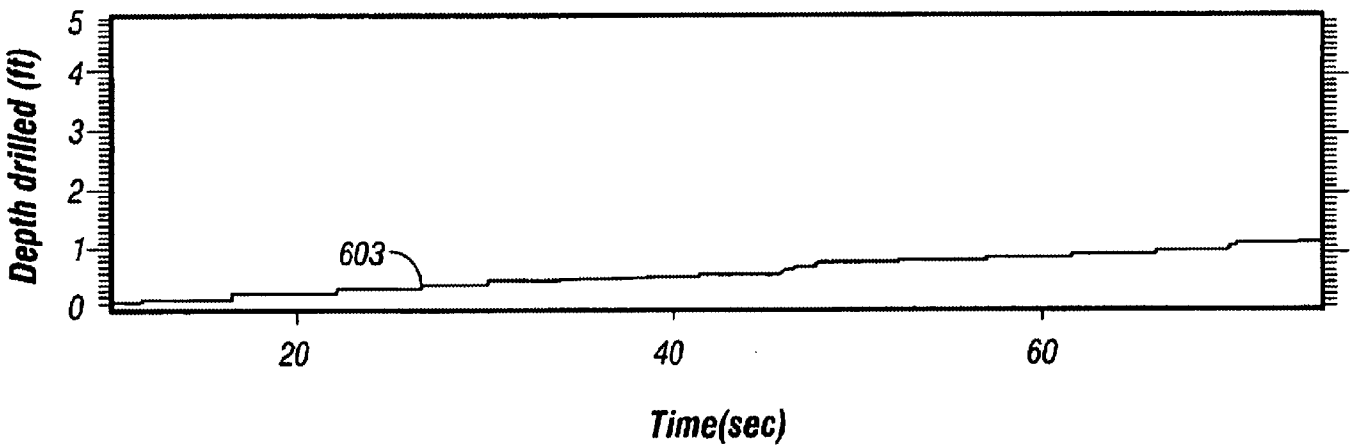

Since the bit penetrates the formation by crushing (rock bits) or shearing (PDC bits) the rock formation, the cumulative bit displacement can be used to compute the resulting ROP. Also, since bit vibrates (axially) about a mean, the displacement below the mean is the one that accounts for the rock penetration. In this method therefore, starting from the initial position, the displacements of the bit at locations where it has a minimum value are added consecutively, to obtain the cumulative displacement as the time progresses. Note that in FIG. 6*b*, depth is positive downward and increases with time. Using the time elapsed at each of those locations of maximum downward displacement, the depth and an incremental ROP is calculated as follows:

$$Depth_N = \sum_{i=1}^{i=N} |d_i| \tag{6}$$

and $$ROP_N = \frac{|d_N|}{t_N - t_{N-1}} \tag{7a}$$

or $$\frac{\sum_{i=1}^{N} |d_i|}{T_N} \tag{7b}$$

where i represents the locations at which the displacement $d_i$ is minimum as seen on FIG. 5*c*. Eq. (7a) give an incremental ROP while eq. (7b) gives an average ROP. Shown in FIG. 6 are the ROP and depth derived using this method. Obviously, if the accelerometer output is positive downward, then maxima are selected.

In another embodiment of the invention, the instantaneous rate of penetration is determined by a frequency analysis of the accelerometer data. The instantaneous ROP is determined using $$ROP_{inst} = \frac{k \cdot A}{f^2} \tag{8}$$

where k is a scaling factor, A is the average acceleration magnitude and $f$ is the median instantaneous frequency of the accelerometer signal. A is determined as the average magnitude of the envelope of the accelerometer output over a time window. $f$ is obtained by first determining the instantaneous frequency of the accelerometer output for a plurality of times over a time window and then taking its median value. Determination of the instantaneous frequency of a signal would be known to those versed in the art and is discussed, for example, in a paper by Barnes entitled "The Calculation of Instantaneous frequency and Instantaneous bandwidth", *Geophysics v.* 57 no. 11, pp 1520–1524.

In another embodiment of the invention, three-component accelerometers are used to give three components of motion of the downhole tool instead of just the axial component. The three components are preferably responsive to three orthogonal components of motion. Using the methodology described above, three components of movement of the downhole assembly can be obtained. These may then be combined to give a true vertical depth (TVD) of the downhole assembly.

Referring back to FIGS. 2*a*, 2*b* and 3, in one embodiment of the invention, the ROP and the distance moved by the downhole assembly are determined using the methods described above. This determined ROP is then used to activate the one or more transmitters on the downhole assembly whenever the downhole assembly travels a specified distance along the borehole. This makes it possible to process the acoustic data using methods similar to those used in wireline application.

Figure 2B:
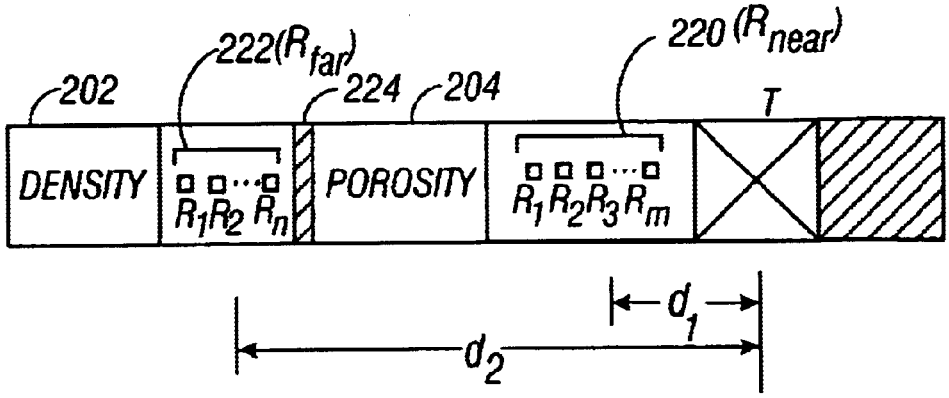
FIG. 2*b* shows an alternative embodiment of an acoustic sensor system for use in conjunction with the system of the present invention.

Still referring to FIGS. 2*a*, 2*b* and 3, the embodiment of the invention discussed in can also be used in other types of MWD measurements where it is useful to obtain measurements that are affected by the tool position in the borehole and borehole rugosity (including washouts). Examples of these are resistivity measurements and nuclear measurements. The method of the present invention can also be used in conjunction with reservoir sampling devices. Examples of such devices are given in U.S. Pat. Nos. 5,803,186, 6,047,239 and 6,157,893 (to Berger et al). As would be known to those versed in the art, knowledge of the absolute depth from which a formation fluid sample is recovered is of great importance in reservoir evaluation and development. Typically, the fluid sampling is done when the depth of the formation fluid sampling device equals a specified value. Alternatively, the fluid sampling device may be operated at an approximate depth determined from surface measurements. The present invention is particularly suitable for reliable depth determination in such cases.

In order to determine the true formation depth reliably, the present invention when used in conjunction with a MWD embodiment starts out with a reference depth measurement at which drilling is started. This may be obtained by any of several methods. One such method uses a suitable navigation tool, such as a gyro device or a magnetic survey tool, on a downhole device to determine an absolute measurement at which drilling is started. Reference markers, such as radioactive markers or magnetic markers on casing can also be used. Subsequently, using the accelerometer based measurements described above, the absolute depth and/or the true vertical depth are determined as drilling progresses.

The method of the present invention is also suitable for use with wireline tools. As noted in the section on the "Background of the Invention", wireline tools are susceptible to sticking. In addition, the stretch of the cable may be non-uniform when the cable itself is binding within the borehole. The method of the present invention is also suitable for use with wireline logging tools. As would be known to those versed in the art, wireline logging tools in a borehole are typically lowered to a specified depth and then withdrawn from the borehole. This ensures that there is always tension on the wireline and the tool moves at a rate similar to the rate at which the wireline is being wound onto a takeup spool at the surface. When measurements are made with the tool being lowered into the borehole, there is a possibility that the actual tool motion may be much slower than the rate wt which the wireline is released at the surface: this results in possibly a significant difference between depths measured at the surface and the actual tool depth. However, in rare occasions, measurements may be made with a wireline tool while the tool is being lowered. In either case, the present invention may be used substantially as described above with the difference that the term "Rate of Penetration" does not have the same meaning it does for a drilling assembly. Accordingly, when used with a wireline tool, the more accurate term "Rate of movement of the tool" may be used.

There are also situations in which relative depth from the bottom of the hole is of particular interest. This could be determined either when pulling a drillstring or a wireline out of a drilled hole, or it could also be relative depth from a previously established well bottom. Another situation where relative depth is important by itself is with reference to a stratigraphic marker. The stratigraphic marker may be established by other logging tools and indicate when a particular geologic boundary has been crossed. In many situations, it is desirable to start a formation evaluation at a specified depth from the top of a particular stratigraphic marker. The present invention is useful in such situations.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A method of determining a depth of a downhole drilling assembly conveyed in a borehole during drilling of the borehole in an earth formation by a drillbit on the drilling assembly, the method comprising:

(a) making measurements with at least one accelerometer on the downhole assembly at a plurality of times, said measurements indicative of at least an axial component of motion of the drilling assembly;

(b) integrating said accelerometer measurements and obtaining an axial velocity of the downhole assembly at the plurality of times;

(c) subtracting an average velocity from said axial velocity to give a corrected velocity; and (d) determining said depth from said corrected velocity and said average velocity.

2. The method of claim 1 wherein the at least one accelerometer comprises a three-component accelerometer, the method further comprising determining a true vertical depth of the borehole.

3. The method of claim 2 wherein determining said true vertical depth further comprises obtaining and using a reference depth value.

4. The method of claim 3 wherein obtaining said reference depth further comprises using a navigation tool on the downhole assembly.

5. The method of claim 4 wherein using said navigation tool further comprises using an inertial navigation tool.

6. The method of claim 1 further comprising using, at a depth related to said determined depth, an additional device on the downhole assembly selected from (i) a porosity measurement device, (ii) an acoustic sensor device, (iii) a resistivity measurement device, (iv) a density measuring device, and, (v) a formation fluid sampling device for retrieving a fluid sample from said formation.

7. The method of claim 1 wherein said depth is a depth relative to a marker.

8. The method of claim 7 wherein said marker is selected from (i) a radioactive marker, (ii) a magnetic marker, (iii) a stratigraphic marker, and, (iv) a previously established bottom hole.

9. The method of claim 1 wherein said depth is a depth relative to a depth established using a navigation tool on the downhole assembly.

10. The method of claim 1 further comprising (I) using, at a depth related to said determined depth, an additional device on the downhole assembly selected from (i) an acoustic sensor device, and, (ii) a resistivity measurement device, and (II) activating a transmitter on said additional device.

11. The method of claim 1 wherein determining said depth from said average velocity further comprises:

(i) integrating said corrected velocity to give an axial displacement, and (ii) subtracting from said axial displacement a product of said average velocity and time.

12. A method of determining a parameter of interest of a downhole drilling assembly conveyed in a borehole during drilling of the borehole by a drillbit on the drilling assembly, the method comprising:

(a) making measurements with at least one accelerometer on the downhole assembly at a plurality of times, said measurements indicative of at least an axial component of motion of the downhole assembly with an accelerometer thereon;

(b) determining at at least one of said plurality of times from said accelerometer measurements an average acceleration magnitude and an instantaneous frequency of said measurements; and (c) determining the parameter of interest from said average acceleration magnitude and said instantaneous frequency at the at least one of said plurality of times.

13. The method of claim 12 wherein the parameter of interest comprises a rate of penetration of the downhole assembly.

14. The method of claim 13 wherein the at least one accelerometer comprises a three-component accelerometer and the parameter of interest comprises a true vertical depth of the borehole.

15. A method of determining a depth of a logging tool conveyed on a wireline in a borehole during the method comprising:

(a) making measurements with at least one accelerometer on the logging tool at a plurality of times, said measurements indicative of at least an axial component of motion of the logging tool;

(b) determining from said accelerometer measurements an axial velocity of the logging tool at the plurality of times;

(c) identifying a plurality of maxima or a plurality of minima of said axial velocity; and (d) determining a rate of penetration from said plurality of maxima or plurality of minima.

16. The method of claim 15 wherein the at least one accelerometer comprises a three-component accelerometer, the method further comprising determining a true vertical depth of the logging tool.

17. The method of claim 15 further comprising integrating said rate of penetration and obtaining said depth.

* * * * *